US005909946A

United States Patent [19]

Okajima

[11] Patent Number: 5,909,946

[45] Date of Patent: Jun. 8, 1999

[54] SNOWBOARD BOOT POWER LACING CONFIGURATION

[75] Inventor: Shinpei Okajima, Izumi, Japan

[73] Assignee: Shimano Inc., Sakai, Japan

[21] Appl. No.: 09/027,904

[22] Filed: Feb. 23, 1998

[51] Int. Cl.[6] ..... A43C 11/00; A43B 5/04

[52] U.S. Cl. ..... 36/50.1; 36/50.5

[58] Field of Search ..... 36/50.1, 50.5, 36/51, 56, 98, 92, 170, 58.5

[56] References Cited

U.S. PATENT DOCUMENTS

| | | | |
|---|---|---|---|
| 5,042,120 | 8/1991 | Nichols | 36/50.1 |
| 5,184,378 | 2/1993 | Batra | 36/50.1 |
| 5,271,130 | 12/1993 | Batra | 36/50.1 |
| 5,377,430 | 1/1995 | Hatfield et al. | 36/50.1 |
| 5,564,203 | 10/1996 | Morris | 36/50.1 |
| 5,566,474 | 10/1996 | Leick et al. . | |
| 5,692,320 | 12/1997 | Nichols | 36/50.1 |

FOREIGN PATENT DOCUMENTS

| | | |
|---|---|---|
| 0 749 702 | 12/1996 | European Pat. Off. . |
| 9-201207 | 8/1997 | Japan . |
| 9-252802 | 9/1997 | Japan . |

*Primary Examiner*—Paul T. Sewell
*Assistant Examiner*—Anthony Stashick
*Attorney, Agent, or Firm*—Shinjyu An Intellectual Property Firm

[57] ABSTRACT

The invention relates to a shoe lacing configuration where short straps attached to sides of an article of footwear are formed with loops. At least one long strap extends through the loops in the one pair of the short straps, the long strap extending from side to side of the article of footwear. The long strap is further formed with loops at either end thereof. A lace extends through the loops in the long strap. The long strap has the effect of doubling the force applied to the lace on the short straps in a manner similar to that of a block and tackle thus improving the lace tightening characteristics of the article of footwear.

10 Claims, 7 Drawing Sheets

SNOWBOARD BOOT POWER LACING CONFIGURATION

BACKGROUND OF THE INVENTION

A. Field Of The Invention

The invention relates to a lacing configuration for footwear and in particular to a lacing configuration for a snowboard boot.

B. Description Of The Related Art

The laces on boots and large articles of footwear generally are difficult to tighten, especially when wet.

Boots are usually formed with a sole and an upper portion. The upper portion is usually made of a pliable material such as leather or a leather-like material. The upper portion is usually formed with central opening. A tongue is formed on a lower end of the opening, the tongue extending between the sides of the opening. The sides of the opening are usually formed with loops or eyelets through which a lace extends. The lace typically extends through the loops or eyelets in a criss-cross manner, going from side to side through the loops and eyelets. Typically the eyelets or loops are formed on opposite sides of the opening in equal numbers at equally spaced apart intervals, defining pairs of eyelets or loops.

When putting the boots on, the lower portions of the laces must typically be pulled tight near eyelets or loops separately from the tightening of the ends of the lace. For example, a large boot typically has seven or eight pairs of eyelets or loops through which the lace extends. Often a boot user must pull portions of the lace near a second or third set of eyelets tight and then successively move up the pairs of eyelets, grab the corresponding portions of the lace and tighten it further until the top or ends of the lace are finally tightened. Such an operation is particularly difficult if the boot and lace are wet from prior usage of the boot. Whether the lace is wet or dry, the criss-cross configuration of the lace and friction make it very difficult to tighten the lace easily.

SUMMARY OF THE INVENTION

One object of the present invention is to provide an article of footwear with a lace configuration which is easier to tighten.

In one aspect of the present invention, an article of footwear includes a sole portion and an upper portion adhered to the sole portion. The upper portion is formed with a generally central extending tongue portion on an upper surface thereof. A first short strap and a second short strap are fixed to lower edges of the upper portion. The first short strap is fixed to a left side of the upper portion and the second short strap is fixed to a right side of the upper portion. The first and second short straps are positioned at generally corresponding right and left sides of the upper portion. Each of the first and second short straps define a loop having a ring extending through the loop. A long strap extends through the ring of the first short strap and further extends through the ring of the second short strap. The first long strap has loops formed at each end thereof. A lace extends in a criss-cross manner through the loops formed in the long strap, respectively, for tightening the article of footwear on a foot. The long strap provides leverage to the lace for tightening the article of footwear on the foot.

Preferably, the article of footwear further includes a third short strap and a forth short strap fixed to lower edges of the upper portion, the third short strap being fixed to a left side of the upper portion and the fourth short strap fixed to a right side of the upper portion. The first, second, third and fourth short straps are spaced apart from one another on the right and left sides of the upper portion. Each of the third and fourth short straps define a loop having a ring extending through the loop. A second long strap extends through the ring of the third short strap and further extends through the ring of the fourth short strap. The second long strap has loops formed at each end thereof. The lace extends in a criss-cross manner through the loops formed in the long strap and the second long strap, respectively, for tightening the article of footwear on a foot. The long strap and the second long strap provide leverage to the lace for tightening the article of footwear on the foot.

Preferably, the article of footwear further includes a fifth short strap and a sixth short strap fixed to lower edges of the upper portion. The fifth short strap is fixed to a left side of the upper portion and the sixth short strap is fixed to a right side of the upper portion. The first, second, third, fourth, fifth and sixth short straps are spaced apart from one another on the right and left sides of the upper portion. Each of the fifth and sixth short straps define a loop having a ring 15 extending through the loop. A third long strap extends through the ring of the fifth short strap and further extends through the ring of the sixth short strap, the third long strap having loops formed at each end thereof. The lace extends in a criss-cross manner through the loops formed in the long strap and the second and third long straps, respectively, for tightening the article of footwear on a foot.

Preferably, the article of footwear further includes a seventh short strap and an eighth short strap fixed to lower edges of the upper portion. The seventh short strap is fixed to a left side of the upper portion and the eighth short strap is fixed to a right side of the upper portion. The first, second, third, fourth, fifth, sixth, seventh and eighth short straps are spaced apart from one another on the right and left sides of the upper portion, each of the seventh and eighth short straps defining a loop having a ring extending through the loop. A fourth long strap extends through the ring of the seventh short strap and further extending through the ring of the eighth short strap, the fourth long strap having loops formed at each end thereof. The lace extends in a criss-cross manner through the loops formed in the long strap and the second, third and fourth long straps, respectively, for tightening the article of footwear on a foot. The long straps provide leverage to the lace for tightening the article of footwear on the foot.

Preferably, the article of footwear further includes a ninth short strap and a tenth short strap fixed to lower edges of the upper portion. The ninth short strap is fixed to a left side of the upper portion and the tenth short strap is fixed to a right side of the upper portion. The first, second, third, fourth, fifth, sixth, seventh, eighth, ninth and tenth short straps are spaced apart from one another on the right and left sides of the upper portion, each of the ninth and tenth short straps defining a loop having a ring extending through the loop. A fifth long strap extends through the ring of the ninth short strap and further extends through the ring of the tenth short strap, the fifth long strap having loops formed at each end thereof. The lace extends in a criss-cross manner through the loops formed in the long strap and the second, third, fourth and fifth long straps, respectively, for tightening the article of footwear on a foot, the long strap and the second, third, fourth and fifth long straps providing leverage to the lace for tightening the article of footwear on the foot.

Preferably, all of the rings are made of metal.

Preferably, each of the loops in the long strap, the second, third, fourth and fifth straps are formed from a looped section of strap material which defines a ring through which the lace extends.

Preferably, each of the loops in the long strap, the second, third, fourth and fifth straps includes a separate ring, each ring extending through a corresponding looped section of strap material formed at each corresponding end of each of the long strap, the second, third, fourth and fifth long strap, and the lace extends through the separate rings.

Preferably, each of the separate rings is made of metal.

Alternatively, the short straps may be formed with loops through which the long straps may extend and the rings therefore are eliminated.

These and other objects, features, aspects and advantages of the present invention will become more fully apparent from the following detailed description of the present invention when taken in conjunction with the accompanying drawings where like reference numerals denote corresponding parts throughout.

DESCRIPTION OF THE PREFERRED EMBODIMENTS

Figure 1:
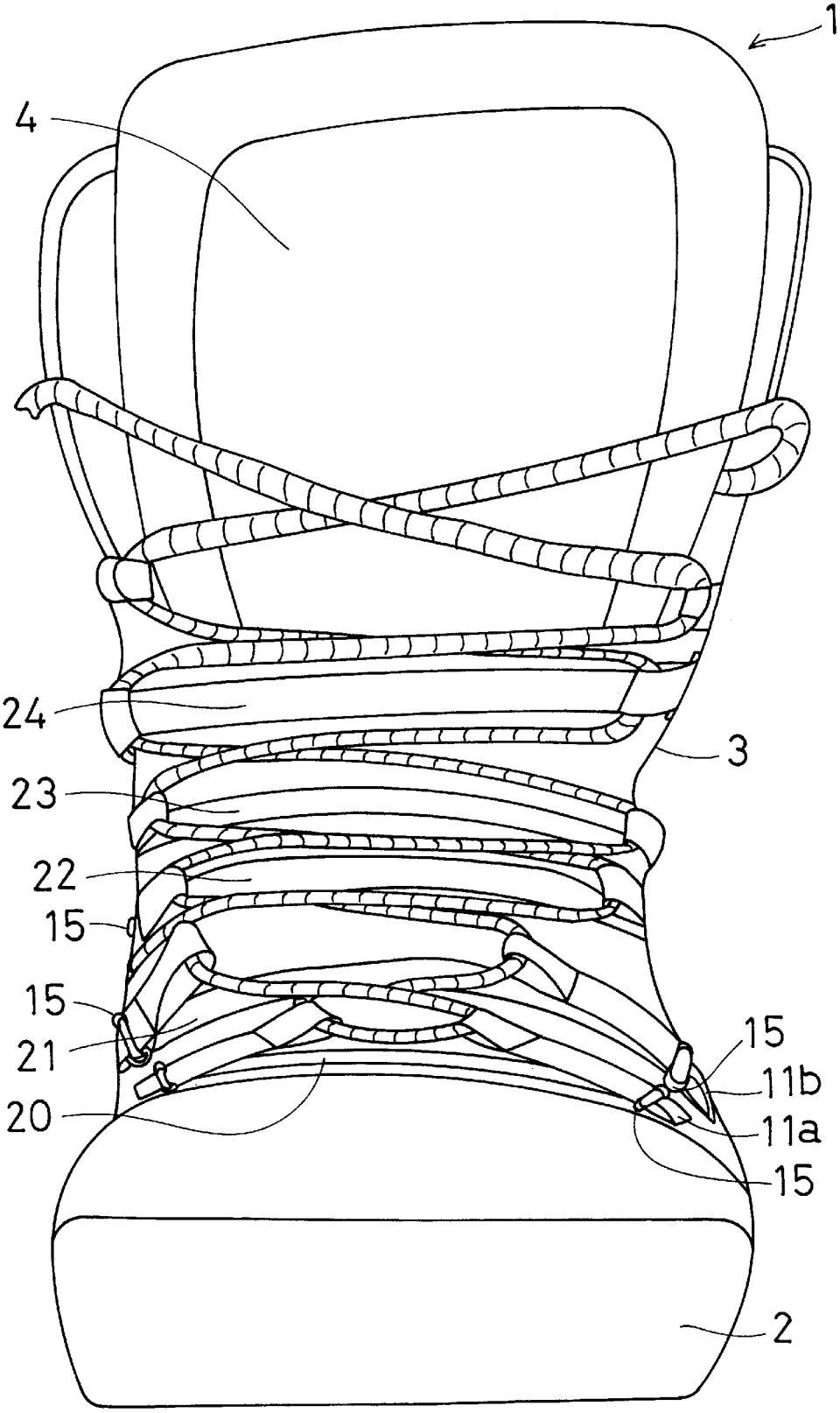
FIG. 1 is a front view of a boot having a double lacing configuration in accordance a first embodiment of the present invention, where a long lace extends through rings of a plurality of straps.
Figure 2:
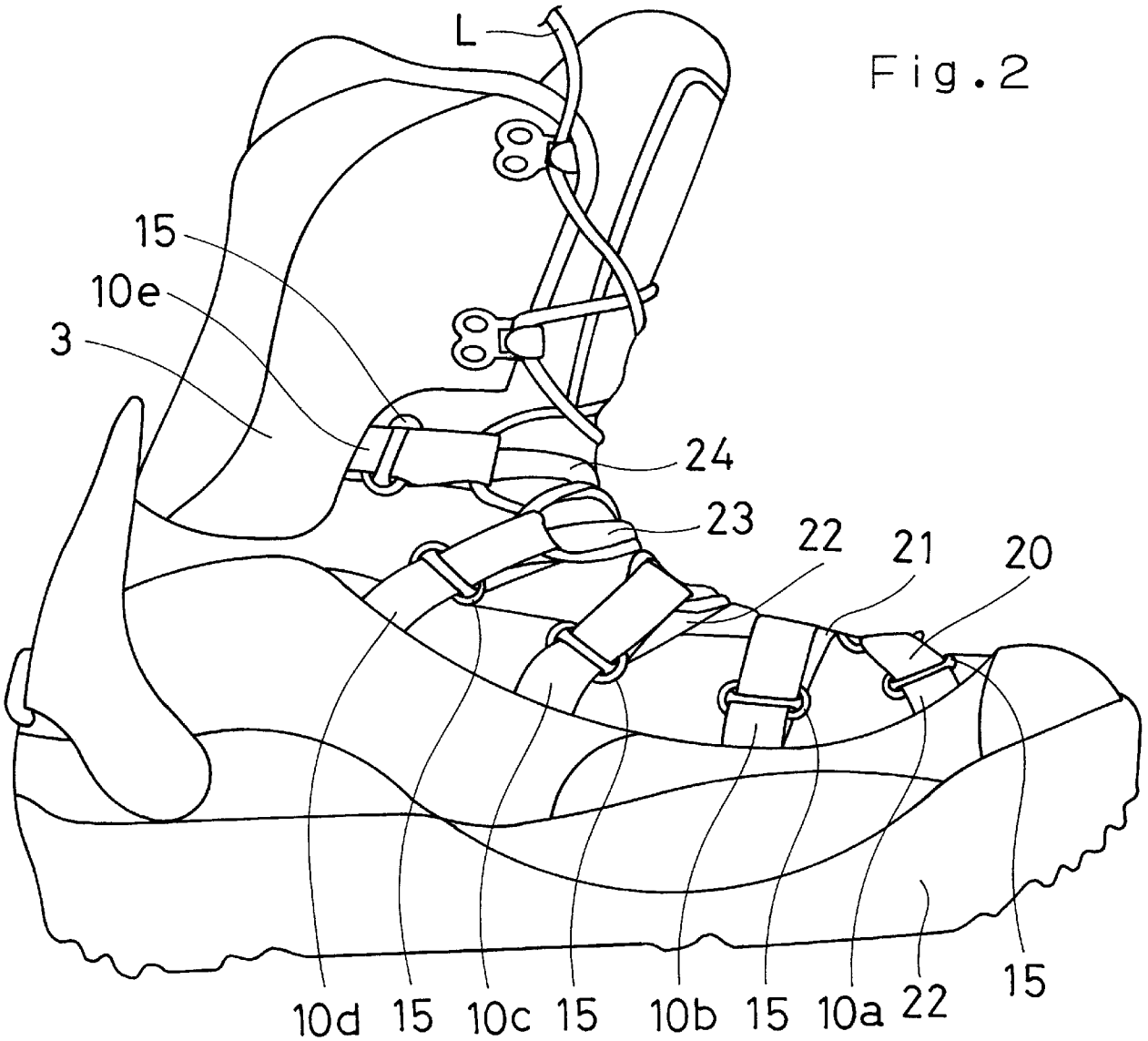
FIG. 2 is a side view of the boot depicted in FIG. 1.

A boot 1 is shown in FIG. 1 which includes a power lacing configuration in accordance with a first embodiment of the present invention. The boot 1 shown in FIGS. 1 and 2 is a snowboard boot. However, the lacing configuration in accordance with the present invention may be employed on any of a variety of boots or footwear. For instance, the lacing configuration could be used on running shoes, bicycle racing shoes, hiking boots, ski boots, snowboard boots or others.

The boot 1 includes a sole portion 2 made of a sole forming material and an upper portion 3 adhered to the sole portion 2. The upper portion 3 is formed with a generally central extending tongue portion 4 which extends between sides of an opening formed in the upper portion 3. Each side of the upper portion 3 is formed with a plurality of short straps. The short straps are divided into two sets of straps, a first set of short straps 10*a*, 10*b*, 10*c*, 10*d* and 10*e* and a second set of short straps 11*a*, 11*b*, 11*c*, 11*d* and 11*e*. The first set of short straps are fixed to a lower edge of a first side of the upper portion 3, and the second set of short straps are fixed to a lower edge of a second side of the upper portion 3, as shown in FIGS. 1 and 2.

The short strap 10*a* and the short strap 11*a* are positioned at corresponding locations on the first and second sides of the upper portion 3. Similarly, the short strap 10*b* and the short strap 11*b* are positioned at corresponding locations on the first and second sides of the upper portion 3. Similarly, all the other short straps of the first set of short straps (10*c*, 10*d* and 10*e*) and the second set of short straps (11*c*, 11*d* and 11*e*) are positioned at corresponding locations on the first and second sides of the upper portion 3. All of the short straps of the of the first set of straps 10*a*, 10*b*, 10*c*, 10*d* and 10*e* and of the second set of straps 11*a*, 11*b*, 11*c*, 11*d* and 11*e* are spaced apart from each other by predetermined intervals which may vary depending on the footwear application.

It should be appreciated that the number of short straps in each of the first and second set of short straps may vary. In the preferred embodiment depicted five short straps are included in each of the first and second sets of short straps. However the number of short straps in each set may be less or more depending on the type of footwear on which the lacing configuration of the present invention is to be employed. For example, only one short strap on each side of a shoe could be utilized, especially if the shoe is small. On a pair of running shoes, perhaps each of the first and second sets of short straps might have only two or three short straps. However, on a pair of boots, for instance, hiking boots, ski boots or the snow board boots depicted in FIGS. 1 and 2, five short straps in each of the first and second sets of short straps is the preferred embodiment.

Each of the short straps in the first and second sets of short straps are formed with a loop at an end thereof. A ring 15 extends through each end loop of short straps 10*a*, 10*b*, 10*c*, 10*d*, 10*e*, 11*a*, 11*b*, 11*c*, 11*d* and 11*e*.

A first long strap 20 extends through the ring 15 of the short strap 10*a* and further extends through the ring 15 of the short strap 11*a*. The first long strap 20 has loops formed at each end thereof. A second long strap 21 extends through the ring 15 of the short strap 10*b* and further extends through the ring 15 of the short strap 11*b*. The second long strap 21 has loops formed at each end thereof.

A third long strap 22 extends through the ring 15 of the short strap 10*c* and further extending through the ring 15 of the short strap 11*c*. The third long strap 22 having loops formed at each end thereof. A fourth long strap 23 extends through the ring 15 of the short strap 10*d* and further extends through the ring 15 of the short strap 11*d*. The fourth long strap 23 has loops formed at each end thereof. A fifth long strap 24 extends through the ring 15 of the short strap 10*e* and further extends through the ring 15 of the short strap 11*e*. The fifth long strap 24 has loops formed at each end thereof.

A lace L extends in a criss-cross manner through the loops formed in the first, second, third, fourth and fifth long straps 20, 21, 22, 23 and 24, respectively, for tightening the article of footwear on a foot. The first second, third, fourth and fifth long straps 20, 21, 22, 23 and 24 provide leverage to the lace for tightening the article of footwear on the foot.

It should be appreciated, that the number of long straps 20, 21, 22, 23 and 24 corresponds to the number of straps in each set of short straps. Specifically, in the depicted embodiment there are five long straps 20, 21, 22, 23 and 24. The five long straps extend through the five short straps in the first set of short straps 10*a*, 10*b*, 10*c*, 10*d* and 10*e* and through the five short straps in the second set of short straps 11*a*, 11*b*, 11*c*, 11*d* and 11*e*. The long straps further extend over the opening in the upper portion 3 and across the tongue 4. In other shoe applications, the number of long straps 20, 21, 22, 23 and 24 could be varied. As was discussed above with respect to the short straps, in a small shoe application only one long strap 20 might be required. In a running shoe or bicycling shoe, two or three long straps might be employed. The five long straps 20, 21, 22, 23 and 24 are believed to be the optimal number of long straps for a snowboard boot such as that depicted in FIGS. 1 and 2.

In the lacing configuration of the present invention, the rings 15 are preferably made of metal, specifically a plated steel or stainless steel to reduce friction contact between the long straps 20, 21, 22, 23 and 24 and the rings 15. However, the rings 15 could be made of any of a variety of materials such as brass, plastic, etc. Further, the rings 15 could be replaced with connectors, such as a riveted connector with a loop formed on the end through which the long straps 20, 21, 22, 23 or 24 may extend. The connectors could be riveted to the ends of the short straps 10*a*–10*e* and 11*a*–11*e*.

Figure 5:
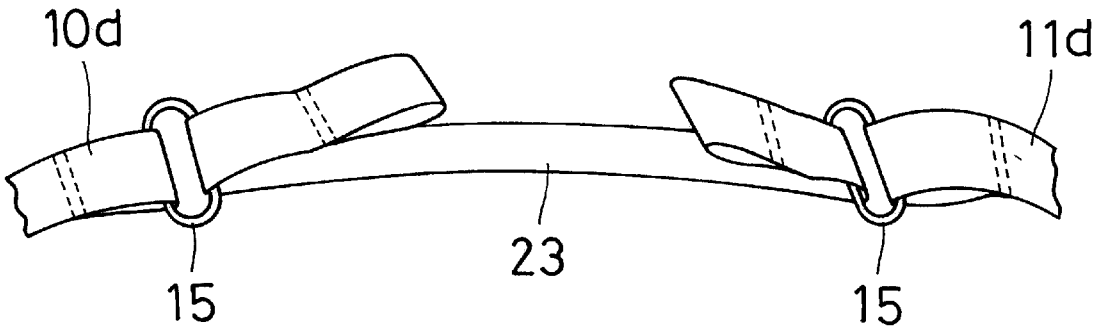
FIG. 5 is a front perspective view similar to FIG. 4, showing a single strap of a boot in accordance with the first embodiment of the present invention.

In FIG. 5, the configuration of the long strap 23 is shown in greater detail with the boot 1 and other straps removed. The shape and configuration of the long strap 23 is generally the same as the other long straps 20, 21, 22 and 24 except that the length of the long straps vary. Specifically, the long strap 20 is the shortest of the long straps. Long strap 21 is longer that long strap 20, strap 22 is longer that strap 21, strap 23 is longer that strap 22 and long strap 24 is longer that strap 23. Other than length, each of the long straps 20, 21, 22, 23 and 24 is generally configured uniformly.

The lace L extends in a criss-cross manner through the loops formed in the ends of the first, second, third, fourth and fifth long straps 20, 21, 22, 23 and 24. However, in an alternate embodiment.

Figure 3:
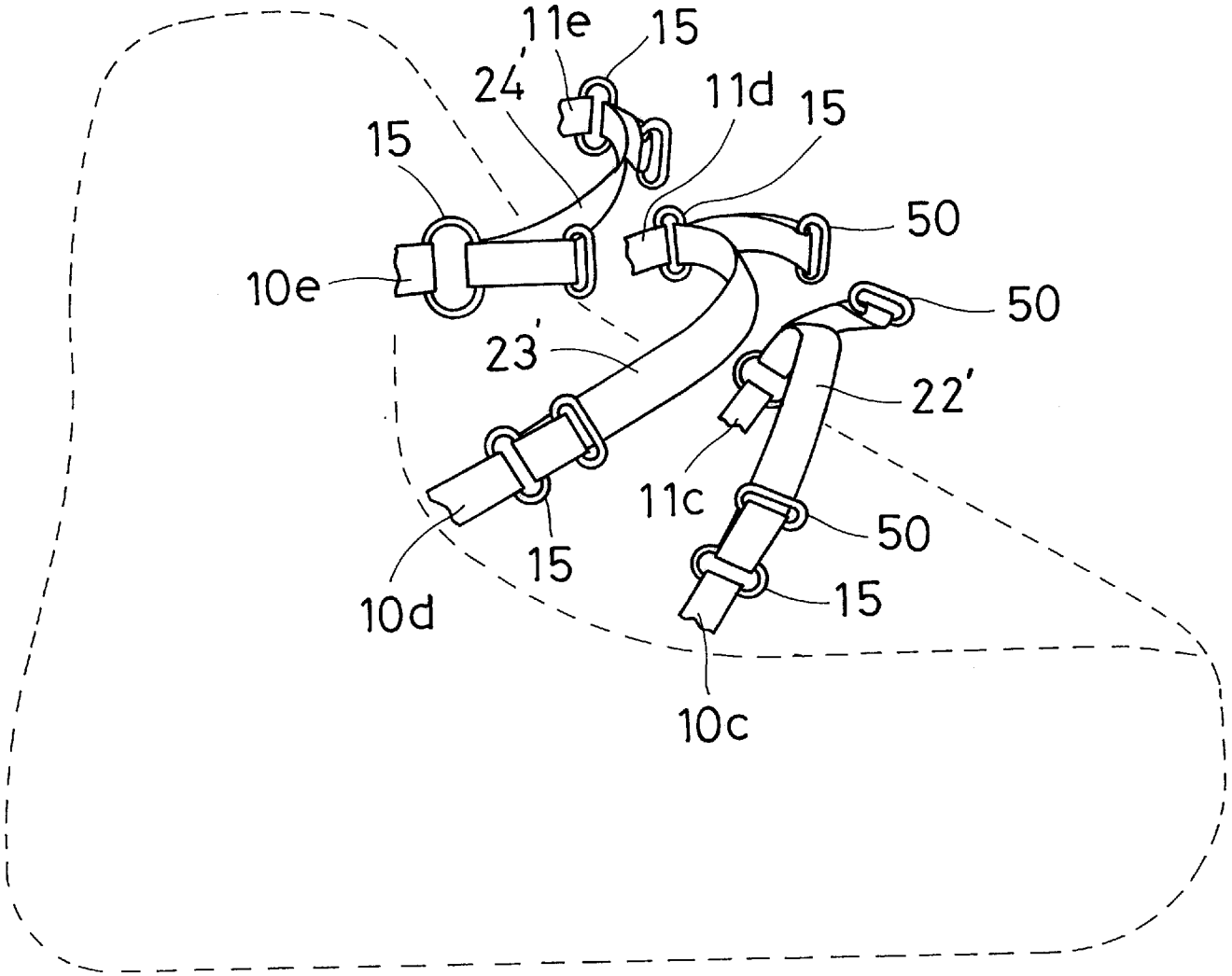
FIG. 3 is a side perspective view of several straps similar to the straps of the boot depicted in FIGS. 1 and 2, with the lace removed to provide greater clarity, in accordance with a second embodiment of the present invention.
Figure 4:
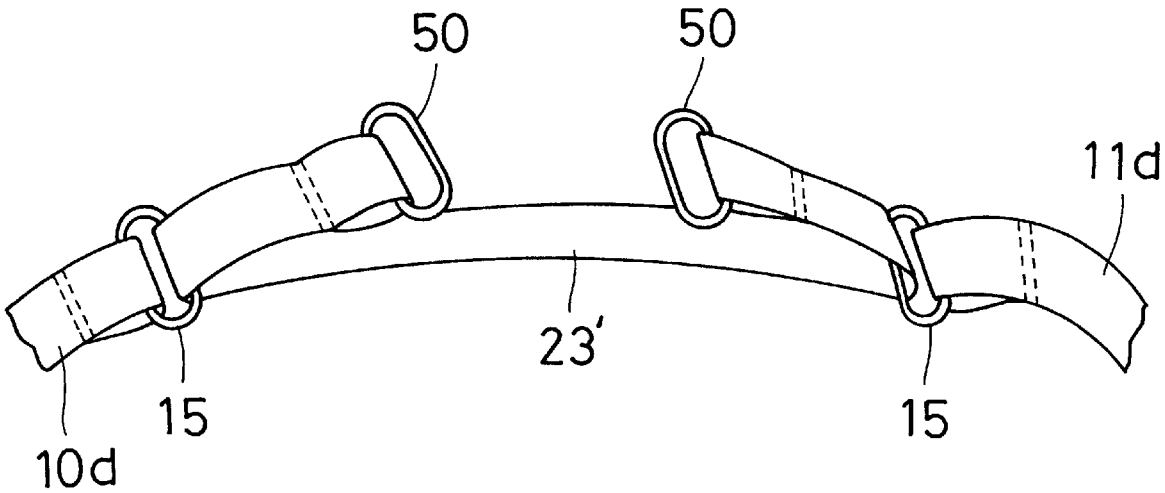
FIG. 4 is a front perspective view of a single strap of the boot depicted in FIG. 3, with the boot, the lace and other straps removed to provide greater clarity.

In FIGS. 3 and 4 a second embodiment of the present invention is depicted. In the second embodiment, the long straps 20, 21, 22, 23 and 24 are formed with loops and each end thereof, and further includes a separate connector or separate ring 50. The separate rings 50 may be generally the same type of ring or connector as the ring 15. The lace L extends through the separate rings 50 in a manner similar to the way the lace L extends through the loops of the long straps in the first embodiment.

Figure 6:
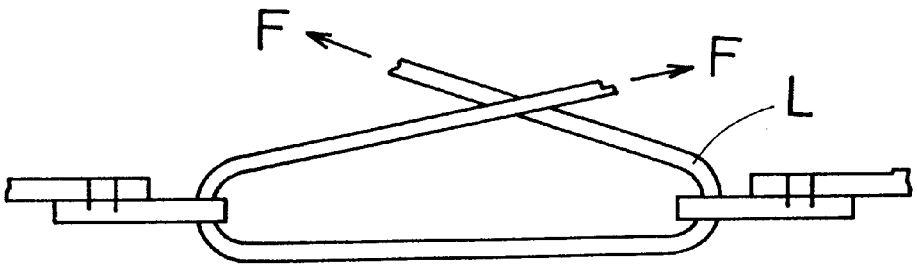
FIG. 6 is an end view of portion of a prior art boot lacing configuration.

As shown in FIG. 6, traditional prior art lacing configurations have a lace extending through apertures formed in the sides of an upper shoe portion. A force F applied to the lace causes the lace to be pulled through the apertures for tightening. Any resistance or friction in the aperture with respect to the lace causes the lace to become difficult to tighten. Further, the force F itself contributes to the creation of friction.

Figure 7:
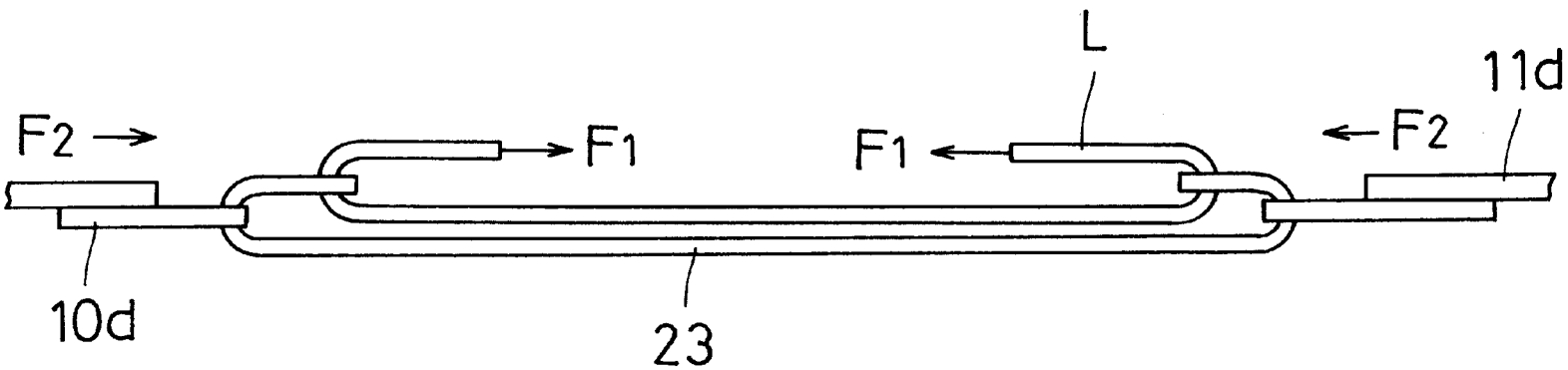
FIG. 7 is an end view of a portion of a boot using the lacing configuration in accordance with the present invention.

In the present invention, as depicted in FIG. 7, the force F1 applied to the long strap 23 is further applied to the short straps 10*d* and 11*d* and is amplified in a manner similar to a block and tackle in that the movement of the long strap 23 is half that of the lace L due to the configuration of the long strap 23 through the ends of the short straps 10*d* and 11*d*. Further, the force F1 is amplified such that a force F2 acting on the short straps 10*d* and 11*d* is generally twice the force F1.

Figure 8:
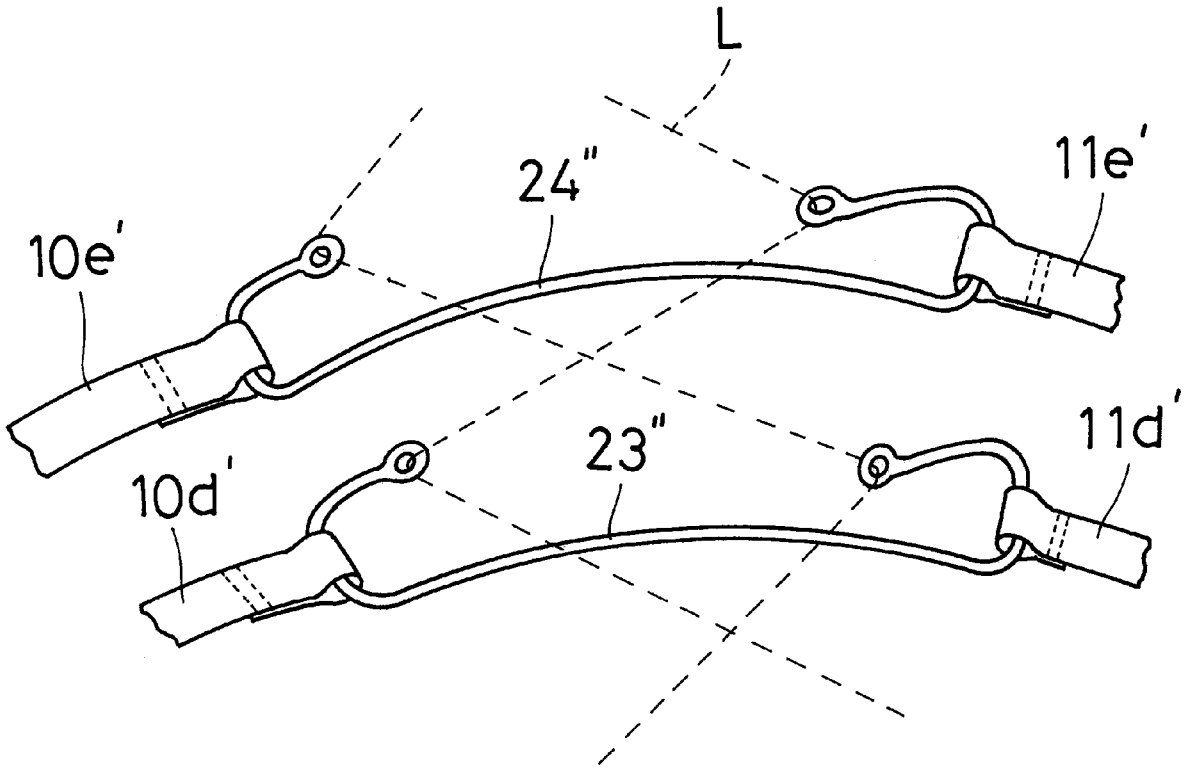
FIG. 8 is a front view similar to FIGS. 4 and 5, showing short straps and long straps in accordance with a third embodiment of the present invention.

A third embodiment of the present invention is depicted in FIG. 8. In FIG. 8, long straps 23" and 24" extend through loops formed in the short straps 10*e*', 10*e*', 11*d*' and 11*e*'. A lace L further extends through loops formed in the long straps 23" and 24". In the third embodiment, the rings 15 are completely eliminated. All of the long and short straps of the present invention can similarly be configured with loops and ends thereof thus eliminating the need for the rings 15.

Figure 9:
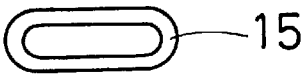
FIGS. 9, 10, 11 and 12 are front views of various rings that may be employed in the first and second embodiments of the present invention.
Figure 10:
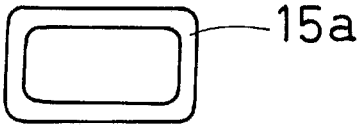
Figure 11:
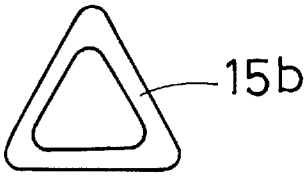
Figure 12:
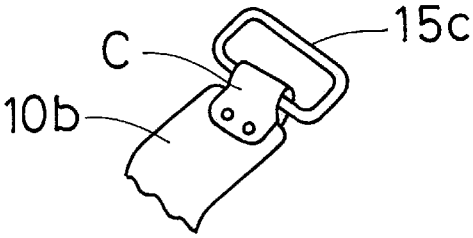

One ring 15 is depicted in FIG. 9, shown removed from the boot 1. The ring 15 also represents the rings 50 in that the rings 15 and 50 need not be the loop as depicted in FIG. 9. Alternatively, the rings 15 and 50 could be shaped with a more rectangular shape such as the ring 15*a* depicted in FIG. 10. Further, the rings 15 and 50 might also be replaced with the triangular shaped connector 15*b*. As well, the rings 15 and 50 could be replaced with the connector 15*c* depicted in FIG. 12. The connector 15*c* includes a ring and a connector portion C which is riveted to, for example, the short strap 10*b*.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An article of footwear comprising:

a sole portion (2) made of a sole forming material;

an upper portion (3) adhered to said sole portion (2), said upper portion (3) formed with a generally central extending tongue portion (4) on an upper surface thereof;

a first short strap (10*a*) and a second short strap (11*a*) fixed to lower edges of said upper portion (3), said first short strap (10*a*) fixed to a left side of said upper portion (3) and said second short strap (11*a*) fixed to a right side of said upper portion (3), said first and second short straps being positioned at generally corresponding right and left sides of said upper portion (3), each of said first and second short straps defining a loop having a ring (15) extending through said loop;

a long strap (20) extending through said ring (15) of said first short strap (10*a*) and further extending through said ring (15) of said second short strap (11*a*), said first long strap (20) having loops formed at each end thereof;

a lace (L), said lace extending in a criss-cross manner through said loops formed in said long strap, respectively, for tightening the article of footwear on a foot, said long strap providing leverage to said lace for tightening the article of footwear on the foot.

2. The article of footwear as set forth in claim 1 further comprising:

a third short strap (10*b*) and a forth short strap (11*b*) fixed to lower edges of said upper portion (3), said third short strap (10*b*) fixed to a left side of said upper portion (3) and said fourth short strap (11*b*) fixed to a right side of said upper portion (3), said first, second, third and fourth short straps being spaced apart from one another on the right and left sides of said upper portion (3), each of said third and fourth short straps defining a loop having a ring (15) extending through said loop;

a second long strap (21) extending through said ring (15) of said third short strap (10*b*) and further extending through said ring (15) of said fourth short strap (11*b*), said second long strap (21) having loops formed at each end thereof; and wherein said lace extends in a criss-cross manner through said loops formed in said long strap and said second long strap, respectively, for tightening the article of footwear on a foot, said long strap and said second long strap providing leverage to said lace for tightening the article of footwear on the foot.

3. The article of footwear as set forth in claim 2 further comprising:

a fifth short strap (10*c*) and a sixth short strap (11*c*) fixed to lower edges of said upper portion (3), said fifth short strap (10*c*) fixed to a left side of said upper portion (3) and said sixth short strap (11*c*) fixed to a right side of said upper portion (3), said first, second, third, fourth, fifth and sixth short straps being spaced apart from one another on the right and left sides of said upper portion (3), each of said fifth and sixth short straps defining a loop having a ring (15) extending through said loop;

a third long strap (22) extending through said ring (15) of said fifth short strap (10*c*) and further extending through said ring (15) of said sixth short strap (11*c*), said third long strap (22) having loops formed at each end thereof; and wherein said lace extends in a criss-cross manner through said loops formed in said long strap and said second and third long straps, respectively, for tightening the article of footwear on a foot, said long strap and said second and third long straps providing leverage to said lace for tightening the article of footwear on the foot.

4. The article of footwear as set forth in claim 3 further comprising:

a seventh short strap (10*d*) and an eighth short strap (11*d*) fixed to lower edges of said upper portion (3), said seventh short strap (10*d*) fixed to a left side of said upper portion (3) and said eighth short strap (11*d*) fixed to a right side of said upper portion (3), said first, second, third, fourth, fifth, sixth, seventh and eighth short straps being spaced apart from one another on the right and left sides of said upper portion (3), each of said seventh and eighth short straps defining a loop having a ring (15) extending through said loop;

a fourth long strap (23) extending through said ring (15) of said seventh short strap (10*d*) and further extending through said ring (15) of said eighth short strap (11*d*), said fourth long strap (23) having loops formed at each end thereof; and wherein said lace extends in a criss-cross manner through said loops formed in said long strap and said second, third and fourth long straps, respectively, for tightening the article of footwear on a foot, said long strap and said second, third and fourth long straps providing leverage to said lace for tightening the article of footwear on the foot.

5. The article of footwear as set forth in claim 4 further comprising:

a ninth short strap (10*e*) and a tenth short strap (11*e*) fixed to lower edges of said upper portion (3), said ninth short strap (10*e*) fixed to a left side of said upper portion (3) and said tenth short strap (11*e*) fixed to a right side of said upper portion (3), said first, second, third, fourth, fifth, sixth, seventh, eighth, ninth and tenth short straps being spaced apart from one another on the right and left sides of said upper portion (3), each of said ninth and tenth short straps defining a loop having a ring (15) extending through said loop;

a fifth long strap (24) extending through said ring (15) of said ninth short strap (10*e*) and further extending through said ring (15) of said tenth short strap (11*e*), said fifth long strap (24) having loops formed at each end thereof; and wherein said lace extends in a criss-cross manner through said loops formed in said long strap and said second, third, fourth and fifth long straps, respectively, for tightening the article of footwear on a foot, said long strap and said second, third, fourth and fifth long straps providing leverage to said lace for tightening the article of footwear on the foot.

6. The article of footwear as set forth in claim 5 wherein all of said rings (15) are made of metal.

7. The article of footwear as set forth in claim 6 wherein each of said loops in said long strap, said second, third, fourth and fifth straps are formed from a looped section of strap material which defines a ring through which said lace extends.

8. The article of footwear as set forth in claim 6 wherein each of said loops in said long strap, said second, third, fourth and fifth straps includes a separate ring, each ring extending through a corresponding looped section of strap material formed at each corresponding end of each of said long strap, said second, third, fourth and fifth long strap, and said lace extends through said separate rings.

9. The article of footwear as set forth in claim 8 wherein each of said separate rings is made of metal.

10. An article of footwear comprising:

a sole portion (2) made of a sole forming material;

an upper portion (3) adhered to said sole portion (2), said upper portion (3) formed with a generally central extending tongue portion (4) on an upper surface thereof;

a first short strap (10*a*) and a second short strap (11*a*) fixed to lower edges of said upper portion (3), said first short strap (10*a*) fixed to a left side of said upper portion (3) and said second short strap (11*a*) fixed to a right side of said upper portion (3), said first and second short straps being positioned at generally corresponding right and left sides of said upper portion (3), each of said first and second short straps defining a loop;

a long strap (20) extending through said loop of said first short strap (10*a*) and further extending through said loop of said second short strap (11*a*), said first long strap (20) having loops formed at each end thereof a lace (L), said lace extending in a criss-cross manner through said loops formed in said long strap, respectively, for tightening the article of footwear on a foot, said long strap providing leverage to said lace for tightening the article of footwear on the foot.

* * * * *